US011600410B2

(12) United States Patent
Yonezawa et al.

(10) Patent No.: US 11,600,410 B2
(45) Date of Patent: Mar. 7, 2023

(54) THERMISTOR WITH PROTECTIVE FILM AND MANUFACTURING METHOD THEREOF

(71) Applicant: MITSUBISHI MATERIALS CORPORATION, Tokyo (JP)

(72) Inventors: Takehiro Yonezawa, Naka (JP); Miki Adachi, Tokyo (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 17/267,818

(22) PCT Filed: Aug. 21, 2019

(86) PCT No.: PCT/JP2019/032636
§ 371 (c)(1),
(2) Date: Feb. 11, 2021

(87) PCT Pub. No.: WO2020/040197
PCT Pub. Date: Feb. 27, 2020

(65) Prior Publication Data

US 2021/0166846 A1 Jun. 3, 2021

(30) Foreign Application Priority Data

Aug. 23, 2018 (JP) ..... JP2018-156647
Aug. 5, 2019 (JP) ..... JP2019-143817
Aug. 5, 2019 (JP) ..... JP2019-143890

(51) Int. Cl.
*H01C 7/00* (2006.01)
*H01C 17/28* (2006.01)
(Continued)

(52) U.S. Cl.
CPC ..... *H01C 7/008* (2013.01); *H01C 1/14* (2013.01); *H01C 1/142* (2013.01); *H01C 17/06526* (2013.01); *H01C 17/281* (2013.01)

(58) Field of Classification Search
CPC ..... H01C 7/008; H01C 17/06526; H01C 17/281; H01C 1/14; H01C 1/142
See application file for complete search history.

(56) References Cited

U.S. PATENT DOCUMENTS 5,750,264 A 5/1998 Ueno et al.
6,535,105 B2 3/2003 Heistand, II et al.
(Continued)

FOREIGN PATENT DOCUMENTS

CN 1421388 A 6/2003
JP S62-020276 A 1/1987
(Continued)

OTHER PUBLICATIONS

Qiang Liangsheng, "Preparation and Characterization of Novel Functional Materials", Harbin Institute of Technology Press, Jun. 30, 2017, pp. X 180-182. (cited in the Nov. 18, 2021 Office Action issued for CN201980054442.5, See English translation of the CN OA for concise explanation of the relevance).
(Continued)

*Primary Examiner* — Kyung S Lee
(74) *Attorney, Agent, or Firm* — Locke Lord LLP; James E. Armstrong, IV; Nicholas J. DiCeglie, Jr.

(57) ABSTRACT

A thermistor has a thermistor element, a protective film, and an electrode portion. The protective film is formed of a $SiO_2$ film having a film thickness in a range of 50 nm or more and 1000 nm or less. The protective film is formed in contact with the thermistor element. Alkali metal is unevenly distributed in a region including an interface between the thermistor element and the protective film.

3 Claims, 7 Drawing Sheets

(51) Int. Cl.

| | |
|---|---|
| ***H01C 1/14*** | (2006.01) |
| ***H01C 1/142*** | (2006.01) |
| ***H01C 17/065*** | (2006.01) |

(56) References Cited

U.S. PATENT DOCUMENTS

| | | | | |
|---|---|---|---|---|
| 6,545,857 | B2 * | 4/2003 | Kishimoto | H01G 2/12 29/25.42 |
| 6,791,163 | B2 * | 9/2004 | Kishimoto | H01C 7/18 257/532 |
| 8,179,225 | B2 * | 5/2012 | Iguchi | H01G 4/30 257/532 |
| 8,339,237 | B2 * | 12/2012 | Kajino | C04B 38/0615 338/307 |
| 9,865,397 | B2 * | 1/2018 | Tanaka | H01G 4/224 |
| 2002/0027764 | A1 * | 3/2002 | Kishimoto | H01G 2/12 361/306.3 |
| 2004/0048052 | A1 | 3/2004 | Kishimoto et al. | |
| 2009/0098710 | A1 * | 4/2009 | Yamazaki | H01L 27/1266 438/798 |
| 2016/0024346 | A1 | 1/2016 | Inoue et al. | |
| 2017/0225433 | A1 | 8/2017 | Okuyama et al. | |

FOREIGN PATENT DOCUMENTS

| | | | |
|---|---|---|---|
| JP | S62-053850 | A | 3/1987 |
| JP | H03-240202 | A | 10/1991 |
| JP | H03-250603 | A | 11/1991 |
| JP | H08-236306 | A | 9/1996 |
| JP | 2002-043167 | A | 2/2002 |
| JP | 2003-077706 | A | 3/2003 |
| JP | 2004-022404 | A | 1/2004 |
| JP | 2004-128488 | A | 4/2004 |
| JP | 2005-005412 | A | 1/2005 |
| JP | 2014-053551 | A | 3/2014 |
| JP | 2017-147336 | A | 8/2017 |
| TW | 200401312 | A | 1/2004 |
| TW | 201303912 | A | 1/2013 |

OTHER PUBLICATIONS

Office Action dated Nov. 18, 2021, issued for Chinese Patent Application No. 201980054442.5 and English translation of the Search Report.

International Search Report dated Nov. 12, 2019, issued for PCT/JP2019/032629 and English translation thereof.

International Search Report dated Nov. 12, 2019, issued for PCT/JP2019/032636 and English translation thereof.

Office Action issued in U.S. Appl. No. 17/267,814, dated Feb. 11, 2022.

Office Action dated Nov. 8, 2022, issued for TW108129758 and English translation of the Search Report.

* cited by examiner

THERMISTOR WITH PROTECTIVE FILM AND MANUFACTURING METHOD THEREOF

CROSS REFERENCE TO RELATED APPLICATIONS

This application is related to co-pending application: "THERMISTOR AND METHOD FOR MANUFACTURING THERMISTOR" filed even date herewith in the names of Takehiro YONEZAWA and Satoko HIGANO as a national phase entry of PCT/JP2019/032629; which application is assigned to the assignee of the present application and incorporated by reference herein.

TECHNICAL FIELD

This invention relates to a thermistor with a protective film and a manufacturing method thereof.

Priority is claimed on Japanese Patent Application No. 2018-156647, filed in Japan on Aug. 23, 2018, Japanese Patent Application No. 2019-143817, filed in Japan on Aug. 5, 2019, and Japanese Patent Application No. 2019-143890 filed in Japan on Aug. 5, 2019, the contents of which are incorporated herein by reference.

BACKGROUND ART

Thermistors have a characteristic by which the electrical resistance thereof changes according to the temperature and are applied in the temperature compensation of various electronic devices, in temperature sensors, and the like. In particular, recently, chip thermistors mounted on circuit boards have been widely used. Such thermistors have a thermistor element (base) and a pair of electrode portions formed at both ends of the thermistor element.

The thermistor element is formed of, for example, a plurality of types of metal oxides and has characteristics of being weak against acids and alkalis and being easily reduced. When the composition of the thermistor element changes, there is a concern that the characteristics of the thermistor may change.

In order to prevent the composition of the thermistor element from changing due to contact with an acid, an alkali, or the like, for example, Patent Document 1 and 2 disclose a technique for forming a protective film on the surface of the thermistor element. There is a demand for such a protective film to have resistance to a plating solution, environmental resistance, insulation, and the like, in order to suppress deterioration of the thermistor element. As a specific example of a protective film, $SiO_2$ films are often used.

CITATION LIST

Patent Document

[Patent Document 1]

Japanese Unexamined Patent Application, First Publication No. H03-250603

[Patent Document 2]

Japanese Unexamined Patent Application, First Publication No. 2003-077706

SUMMARY OF INVENTION

Technical Problem

However, there is a problem in that, with a method for printing a glass paste on a thermistor element to form a thick glass layer as in Patent Document 1 and 2, thinning the protective film is difficult, thus, it is difficult to produce a small thermistor.

On the other hand, in a case where a protective film such as $SiO_2$ is formed by reactive sputtering using a sputtering target such as Si, thinning the protective film is possible, but the composition of the formed protective film may not follow a stoichiometric ratio and a film may be formed in a weakly reduced state such as $SiO_2$-x.

With a film in a weakly reduced state, for example, in a case where there is a firing step for the purpose of forming an electrode or the like in a subsequent step, the thermistor element is thermally reduced such that voids are generated at the interface between the protective film and the thermistor element. There is a concern that such voids may decrease the adhesion between the thermistor element and the protective film, the protective film may peel off, the thermistor element may be eroded, and the characteristics of the thermistor may be changed. In addition, composition unevenness of the thermistor element causes sensitivity decreases and the like in the thermistor, which is not preferable.

In addition, in a case where a protective film is formed by a general wet film-forming method for coating a film-forming raw material liquid, such as dip coating, it is not possible to form the film due to fine irregularities existing on the surface of the thermistor element, the film thickness is thin at the convex portions and thick at the concave portions and it is difficult to obtain a protective film having a uniform film thickness. When the film thickness of the protective film is not uniform, cracks and pinholes are easily generated, resulting in a porous protective film. With such a porous protective film, there is a problem in that it is not possible to sufficiently block the permeation of gas or liquid into the thermistor element and the function as a protective film is lowered.

This invention was made in view of the above circumstances and has an object of providing a thermistor with a protective film with excellent adhesion and which does not easily peel off from a thermistor element.

In addition, an object of the present invention is to provide a method for manufacturing a thermistor with a protective film, which is capable of manufacturing a thermistor with a protective film which has excellent adhesion.

Solution to Problem

In order to solve the above problems, the thermistor with a protective film according to an embodiment of the present invention is a thermistor with a protective film including a thermistor element, a protective film formed of a $SiO_2$ film having a film thickness in a range of 50 nm or more and 1000 nm or less and formed in contact with the thermistor element, and an electrode portion, in which an alkali metal is unevenly distributed in a region including an interface between the thermistor element and the protective film.

According to the thermistor with a protective film of the present invention, unevenly distributing the alkali metal at the interface between the thermistor element and the protective film efficiently promotes the growth of the $SiO_2$ film at this interface and makes it possible to realize a thermistor with a protective film which is adhered to the thermistor element without gaps and for which peeling off does not easily occur.

In addition, in the present invention, as obtained by line analysis in a direction perpendicular to the interface using an energy dispersion type X-ray spectroscopic analyzer, a maximum value of an alkali metal presence ratio, in which a detection amount (atom %) of the alkali metal is divided by a detection amount (atom %) of all metals in a region including the interface, may be 0.03 or more and a value obtained by dividing the maximum value by an average value of the alkali metal presence ratio in the protective film may be 1.5 or more.

A method for manufacturing a thermistor with a protective film according to the present invention is a method for manufacturing the thermistor with a protective film according to the above, the method including a protective film-forming step of forming the protective film by immersing the thermistor element in a reaction solution including silicon alkoxide, an alkali metal, water, an organic solvent, and an alkali, and causing $SiO_2$ to precipitate on a surface of the thermistor element by a hydrolysis reaction and a polycondensation reaction of the silicon alkoxide. Here, the reaction solution may be heated at the boiling point of the solvent or lower in order to improve the reaction rate.

According to the method for manufacturing a thermistor with a protective film of the present invention, by including an alkali metal in the reaction solution and unevenly distributing the alkali metal at the interface between the thermistor element and the protective film efficiently, the growth of the particles at this interface is promoted, making it possible to manufacture a thermistor with a protective film which is adhered to the thermistor element without gaps and for which peeling off does not easily occur.

In addition, the present invention may include an electrode portion-forming step of forming the electrode portion by coating a metal paste on both end surfaces of the thermistor element and carrying out firing, which is a subsequent step to the protective film-forming step.

Advantageous Effects of Invention

According to the thermistor with a protective film of the present invention and the manufacturing method thereof, it is possible to provide a thermistor with a protective film provided with a protective film having a uniform film thickness, excellent smoothness and adhesion and able to be formed at low cost with simple steps, and a manufacturing method thereof.

DESCRIPTION OF EMBODIMENTS

Figure 1:
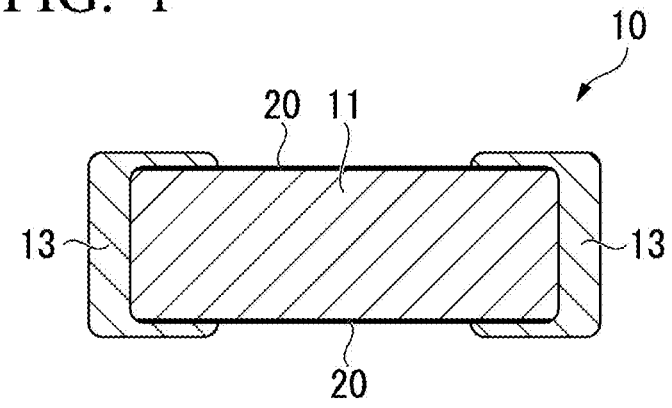
FIG. 1 is a schematic cross-sectional explanatory view of a thermistor with a protective film according to an embodiment of the present invention.

A description will be given below of the thermistor with a protective film of an embodiment of the present invention and a manufacturing method thereof, with reference to the drawings. Here, the embodiments shown below are specifically described in order to better understand the gist of the invention and do not limit the present invention unless otherwise specified. In addition, in the drawings used in the following description, in order to make the characteristics of the present invention easy to understand, for convenience, the main parts may be shown after being enlarged and the dimensional ratios of the respective components may not always be the same as in practice.

(Thermistor with Protective Film)

Figure 2:
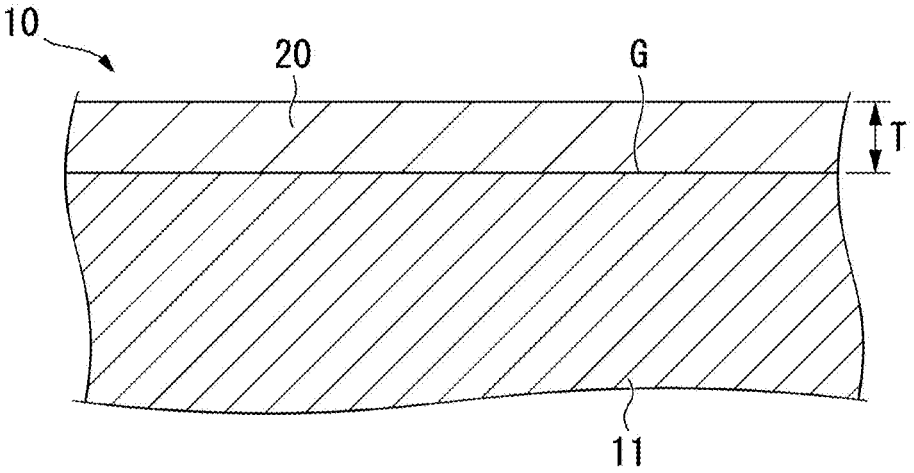
FIG. 2 is an enlarged cross-sectional view of a main part near the protective film of a thermistor with a protective film.

FIG. 1 is a cross-sectional view showing a layer structure of a thermistor with a protective film of an embodiment of the present invention. In addition, FIG. 2 is an enlarged cross-sectional view of a main part showing an interface between a thermistor element and the protective film of the thermistor with a protective film and the periphery thereof.

A thermistor with a protective film (may be simply referred to below as a thermistor) 10 has a resistor having a large change in electrical resistance with respect to temperature changes and may be widely used as a temperature sensor, for example. The thermistor 10 is provided with a thermistor element (base) 11, a protective film 20 formed on the surface of the thermistor element 11, and electrode portions 13 and 13 formed on both end portions of the thermistor element 11.

The protective film 20 is not formed on both end surfaces of the thermistor element 11 and the electrode portions 13 and 13 are formed to be in direct contact with the thermistor element 11 so as to be electrically connected thereto.

The electrode portions 13 and 13 are formed of a fired metal body with excellent conductivity, such as Ag, Cu, and Au. In addition, the electrode portion 13 may have a configuration in which a plating film such as Ni or Sn is formed on the fired body described above.

The thermistor 10 may be formed into a prismatic shape, for example. The size of the thermistor 10 is not particularly limited. As compared with protective film-forming techniques in the related art, the method for manufacturing a thermistor with a protective film described below is particularly useful when forming a film on a thermistor element 11 having a small size which follows even minute irregularities, thus, for example, the length of the thermistor 10 is preferably 2 mm or less, more preferably 1 mm or less, within the acceptable range. In addition, the upper limit of the cross-sectional area of the cross-section orthogonal to the length direction of the thermistor 10 is preferably 0.65 $mm^2$ or less, and more preferably 0.25 $mm^2$ or less, within the acceptable range.

In addition, the thermistor element 11 has a characteristic by which the electrical resistance changes according to the temperature. The thermistor element 11 has a low resistance to acids and alkalis and there is a concern that the composition may change due to a reduction reaction or the like and that the characteristics thereof may change significantly. Thus, in the present embodiment, the protective film 20 for protecting the thermistor element 11 is formed.

There is a demand for the protective film 20 to have resistance to a plating solution, environmental resistance, and insulation. In the present embodiment, the protective film 20 is formed of silicon oxide, specifically, $SiO_2$. The silicon oxide has a high heat resistance and wear resistance and is able to form a uniform and smooth thin film with extremely few cracks and pinholes.

As described in the method for manufacturing a thermistor with a protective film described below, the protective film 20 is formed by precipitating a thin film of $SiO_2$ on the surface of the thermistor element 11 by a hydrolysis reaction or a polycondensation reaction of silicon alkoxide. The protective film 20 formed of $SiO_2$ has excellent adhesion to the thermistor element 11 and has extremely few peeled portions at the bonding interface.

The thickness T of the protective film 20 is formed so as to be within a range of 50 nm or more and 1000 nm or less. In the thermistor 10 of the present embodiment, an alkali metal is unevenly distributed in a region including an interface G between the thermistor element 11 and the protective film 20, for example, in the vicinity of the interface G on the protective film side.

In the method for manufacturing a thermistor with a protective film described below, when a thin film of $SiO_2$ is precipitated in a liquid phase on the surface of the thermistor element 11 by a hydrolysis reaction or a polycondensation reaction of silicon alkoxide, an alkali metal compound, for example, an alkaline compound including NaOH, KOH, NaCl, and KCl is used as a catalyst.

A part of the alkali metal (for example, Na or K) included in the alkali metal compound is present inside the protective film 20 and at the interface G between the thermistor element 11 and the protective film 20; however, in the thermistor 10 of the present embodiment, the alkali metal present in the region including the interface G between the thermistor element 11 and the protective film 20 (near the interface G) has a higher concentration than the alkali metal present inside the protective film 20 in the film thickness direction, and the alkali metal is unevenly distributed in the region including the interface G.

More specifically, the alkali metal is unevenly distributed at the interface G such that, as obtained by line analysis performed perpendicularly across the interface G between the thermistor element 11 and the protective film 20 using an energy dispersion type X-ray spectroscopic analyzer (TEM-EDS), a maximum value of an alkali metal presence ratio, in which a detection amount (atom %) of the alkali metal is divided by a detection amount (atom %) of all the metals in a region including the interface G, is 0.03 or more and a value obtained by dividing the maximum value by an average value of the alkali metal presence ratio in the protective film 20 is 1.5 or more. Here, the average value of the alkali metal presence ratio in the protective film 20 is the ratio of the alkali metal obtained by dividing the detection amount (atom %) of the alkali metal in the entire $SiO_2$ protective film portion by the detection amount (atom %) of all metals, as obtained by the TEM-EDS line analysis described above.

When the alkali metal is unevenly distributed at the interface G between the thermistor element 11 and the protective film 20, the adhesion between the thermistor element 11 and the protective film 20 is improved. For example, according to Reference Literature 1, it is possible to make ultrafine particles of 1 to 2 nm with a general hydrolysis reaction and polycondensation reaction of alkoxide, but these ultrafine particles do not have a firm and solid surface and the surface potential (zeta potential) is in a low state, thus, the repulsion between the particles is small and the particles enter an aggregated state, therefore, the particles are aggregated by Van der Waals forces to generate particles of approximately several hundred nm.

In addition, when the particles grow, the surface of the particles approaches a surface state which may be regarded as $SiO_2$, aggregation among the particles does not occur, and the growth of the particles stops when the ultrafine particles of 1 to 2 nm are consumed. The presence of the alkali metal causes the alkali metal to be adsorbed on the surface of the ultrafine particles and lowers the zeta potential, that is, making aggregation easier. Reference literature 1: D. Nagao, T. Satoh, and M. Konno. Journal of Colloid and Interface Science 232, 102-110 (2000)

Also in the thermistor 10 of the present embodiment, it is considered that, by unevenly distributing the alkali metal at the interface G between the thermistor element 11 and the protective film 20, the zeta potential of the surface of the thermistor element 11 and of the ultrafine particles generated by the hydrolysis reaction and the polycondensation reaction of the silicon alkoxide is lowered to promote aggregation, the protective film 20 having a uniform film thickness is grown, and the adhesion of the protective film 20 to the thermistor element 11 is increased. In a case where the alkali metal is not unevenly distributed at the interface G and a large amount of alkali metal is present in the entire protective film 20, there is a concern that the melting point of the silicon oxide protective film may be lowered, such that the protective film is melted by a heat treatment when the electrode is fired or the like, deviations occur in the film thickness and the thermistor element is exposed.

According to the thermistor 10 of the present embodiment having the above configuration, unevenly distributing the alkali metal at the interface G between the thermistor element 11 and the protective film 20 improves the adhesion between the thermistor element 11 and the protective film 20 and makes it possible to realize the thermistor 10 in which the protective film 20 is not peeled off and the thermistor element 11 is not eroded.

Figure 3:
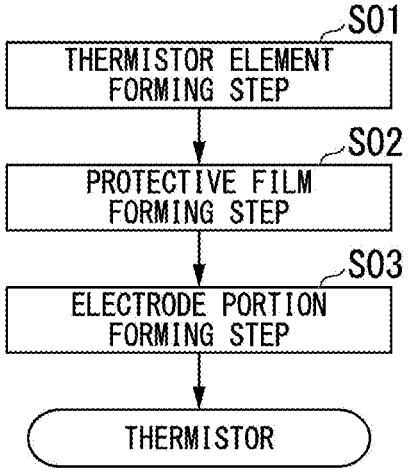
FIG. 3 is a flowchart which shows stages of a method for manufacturing a thermistor with a protective film according to an embodiment of the present invention.

Next, a description will be given of a method for manufacturing a thermistor with a protective film according to an embodiment of the present invention. FIG. 3 is a flowchart showing stages of the method for manufacturing a thermistor with a protective film of the present invention.

(Thermistor Element-Forming Step S01)

First, the thermistor element 11 forming a prismatic shape is manufactured. In the present embodiment, the thermistor element 11 described above is manufactured by cutting a plate material formed of a thermistor material into short strip shapes.

(Protective Film-Forming Step S02)

Next, the thermistor element 11 described above is immersed in a reaction solution including silicon alkoxide, an alkali metal, water, an organic solvent, and an alkali, and silicon oxide ($SiO_2$) is precipitated on the surface of the thermistor element 11 by a hydrolysis and polycondensation reaction of the silicon alkoxide to form the protective film 20.

Specifically, a mixed solution of water and an organic solvent is weighed and stirred in a reaction container, the thermistor element 11 is added to the reaction container together with silicon alkoxide and further stirring is carried out, an alkali metal compound and an alkali are further added thereto as a catalyst, and further stirring is carried out. At this time, the alkali metal compound and the alkali may be the same, such as NaOH, or may be added in a mixed state, such as ammonia water in which NaCl is dissolved. After the silicon alkoxide hydrolysis and polycondensation reaction have proceeded sufficiently, the thermistor element 11 is taken out and washed. This operation is repeatedly carried out to form the protective film 20 having a predetermined film thickness. In order to improve the reaction rate, the reaction solution may be heated at the boiling point of the solvent or lower, or the thermistor element 11 may be heated and dried after the washing.

The organic solvent may be any solvent able to dissolve water and silicon alkoxide, and alcohols having 1 to 4 carbon atoms or a mixture thereof are suitable from the viewpoint of easy availability and handling and compatibility with water.

Silicon alkoxide is a monomer having two or more alkoxy groups or an oligomer obtained by polymerizing these groups; however, from the viewpoint of reactivity, a monomer having four alkoxy groups or an oligomer obtained by polymerizing these groups is preferable and it is also possible to mix the above. The alkyl groups included in the silicon alkoxide may be partially or all the same.

As specific examples of the silicon alkoxide, it is possible to use tetramethyl orthosilicate (TMOS), tetraethyl orthosilicate (TEOS), TMOS oligomers such as Methyl Silicate 51 manufactured by Tama Chemicals Co., Ltd., TEOS oligomers such as Silicate 40 manufactured by Tama Chemicals Co., Ltd., methyltrimethoxysilane, and the like.

Examples of the alkali metal include Na, K, Li, and the like. As a supply source of these alkali metals, it is possible to use NaOH, KOH, LiOH, NaCl, KCl, and the like.

As the alkali, it is possible to use an inorganic alkali such as ammonia, NaOH, LiOH or KOH, or an organic alkali such as ethanolamine or ethylenediamine.

Here, for the hydrolysis and polycondensation reactions of the silicon alkoxide in the present embodiment, an alkali is the catalyst.

In a case where an alkali is used as a catalyst, negatively charged hydroxide ions attack the positively polarized silicon, one of the alkoxy groups is changed to a silanol group in a form via water, and alcohol is released. One of the alkoxy groups with a large steric hindrance is changed to a silanol group with a small steric hindrance, which makes it easier for hydroxide ions to attack, and as a result of the rapid progress of the hydrolysis reaction rate, silanol in which all the alkoxy groups are hydrolyzed is produced and the silanol is dehydrated and condensed three-dimensionally such that it is possible to make silicon oxide particles and a silicon oxide film.

In the present embodiment, an alkali is used as a catalyst in the reaction solution and, by utilizing the hydrolysis reaction and polycondensation reaction of silicon alkoxide using the alkali catalyst, silanol is continuously reacted with the terminal oxygen (—O) and the hydroxyl group (—OH) on the thermistor element surface as the starting point, such that it is possible to obtain the protective film 20 having high adhesion and a uniform thickness even on corners and irregularities.

More specifically, the hydrolysis reaction and polycondensation reaction of silicon alkoxide using an alkali catalyst makes it possible to make silicon oxide ultrafine particles of approximately 1 to 2 nm, for example. These ultrafine particles do not have a firm and solid surface and the surface potential (zeta potential) thereof is in a low state, thus, the repulsion among the particles is small and the particles enter an easily aggregated state, therefore, the ultrafine particles are aggregated by Van der Waals forces to generate $SiO_2$ particles of approximately several hundred nm. When the $SiO_2$ particles grow, the surface of the particles approaches a surface state which may be regarded as $SiO_2$ such that aggregation among the particles does not occur and the growth of the particles stops when the ultrafine particles of approximately 1 to 2 nm are consumed. It is considered that the $SiO_2$ protective film of the present invention can also be generated by the same mechanism as the generation of the $SiO_2$ particles, and the protective film 20 having a uniform thickness of 50 nm or more and 1000 nm or less can be generated.

In addition, by including the alkali metal in the reaction solution, the alkali metals, for example, Na and K, can be unevenly distributed at the interface G between the protective film 20 formed in the protective film forming step $SO_2$ and the thermistor element 11. Alkali metal ions in the reaction solution generated by such alkali metals can be adsorbed on the silicon oxide ultrafine particles generated by the hydrolysis reaction and the polycondensation reaction of the silicon alkoxide and the thermistor element 11 and on the surface of the thermistor element 11 so as to lower the zeta potential thereof.

When the zeta potential of the particles decreases, the particles aggregate easily, thus, the alkali metal is unevenly distributed at the interface G between the protective film 20 and the thermistor element 11 so as to promote the growth of the particles at the interface G, and, as a result, the adhesion between the protective film 20 and the thermistor element 11 is increased. Due to this, it is possible to form the protective film 20 which is adhered to the thermistor element 11 without gaps and for which peeling off does not easily occur.

In the present embodiment, as an example of the degree of uneven distribution of the alkali metal at the interface G between the protective film 20 and the thermistor element 11, as obtained by line analysis in a direction perpendicular to the interface G using an energy dispersion type X-ray spectroscopic analyzer, a maximum value of an alkali metal presence ratio, in which a detection amount (atom %) of the alkali metal is divided by a detection amount (atom %) of all the metals in a region including the interface G, is 0.03 or more and a value obtained by dividing the maximum value by an average value of the alkali metal presence ratio in the protective film 20 is 1.5 or more. Unevenly distributing the alkali metal at the interface G so as to satisfy these conditions efficiently promotes the growth of particles at the interface G and makes it possible to form the protective film 20 which is adhered to the thermistor element 11 without gaps and for which peeling off does not easily occur.

(Electrode Portion Forming Step S03)

Next, electrode portions 13 are formed at both end portions of the thermistor element 11. The protective film 20 is not formed on both end surfaces of the thermistor element 11 and the electrode portions 13 are formed so as to be in direct contact with the thermistor element 11.

In the present embodiment, a metal paste, for example, an Ag paste including Ag particles, is coated on both end portions of the thermistor element 11 and fired to form the electrode portions 13 formed of a fired body of Ag. In addition, a Sn plating film and/or a Ni plating film may be further formed on the fired body of Ag paste.

Here, as described above, when the Ag paste is fired, the heating is carried out, for example, to a temperature range of 700° C. or higher and 900° C. or lower, thus, the thermistor element 11 on which the protective film 20 is formed is also heated in the temperature range described above. For this reason, it is necessary for the protective film 20 to have sufficient adhesion so as to not peel off from the thermistor element 11 even in a case of being heated to the temperature described above.

In the present embodiment, unevenly distributing the alkali metal at the interface G between the protective film 20 and the thermistor element 11 increases the adhesion between the protective film 20 and the thermistor element 11, thus, in the electrode portion forming step S03, the protective film 20 does not peel off from the thermistor element 11 even when heated to a temperature range of 700° C. or higher and 900° C. or lower, for example.

Through the above steps, the thermistor 10 of the present embodiment is manufactured.

Although a description was given of one embodiment of the present invention above, this embodiment is presented as an example and is not intended to limit the scope of the invention. It is possible to implement this embodiment in various other forms and to make various omissions, replacements, and changes in a range not departing from the gist of the invention. These embodiments and modifications thereof are included in the invention described in the claims and the equivalent scope thereof in the same manner as being included in the scope and gist of the invention.

For example, in the present embodiment, a description was given in which a plate material formed of a thermistor material is cut into short strip shapes to obtain a thermistor element and then the thermistor element is immersed in a reaction solution to form a protective film; however, without being limited thereto, a plate material formed of a thermistor material may be immersed in a reaction solution to form a protective film and then cut into short strip shapes to obtain a thermistor element on which a protective film is formed.

In addition, although a description was given of the thermistor element as having a prismatic shape, the present invention is not limited thereto and the thermistor element may have a cylindrical shape or a flat plate shape.

Furthermore, the structure of the electrode portion is not limited to the structure described in the present embodiment and may be another structure.

EXAMPLES

A description will be given of confirmation experiments performed to confirm the effectiveness of the present invention.

Invention Example 1

As a base on which the protective film was formed, a thermistor element having a prismatic shape of 0.18 mm×0.18 mm×38 mm was prepared. Then, 3.0 g of ion-exchanged water, 7.0 g of 99% methanol-modified alcohol (ethanol 89.84%, methanol 10.16%, Vitrex 10 ppm: manufactured by Imazu Chemical Co., Ltd.), 0.25 g of tetraethoxysilane as silicon alkoxide (manufactured by Tama Chemicals Co., Ltd.), and 0.2 g of 0.2 mol/liter NaOH as a catalyst alkali and an alkali metal source were added to a Laboran screw tube bottle No. 5 (volume 20 mL) to prepare a reaction solution.

Then, the thermistor element having the shape described above was added to the reaction solution, stirred and mixed. Then, the mixture was heated in a water bath at 40° C. for 30 minutes to promote a hydrolysis reaction and a polycondensation reaction. After the reaction finished, the thermistor element was taken out, washed with ion-exchanged water, and dried. This operation was repeated until the film thickness of the protective film grew to 200 nm and then a heat treatment was performed at 700° C. for 10 minutes in the air.

Figure 4:
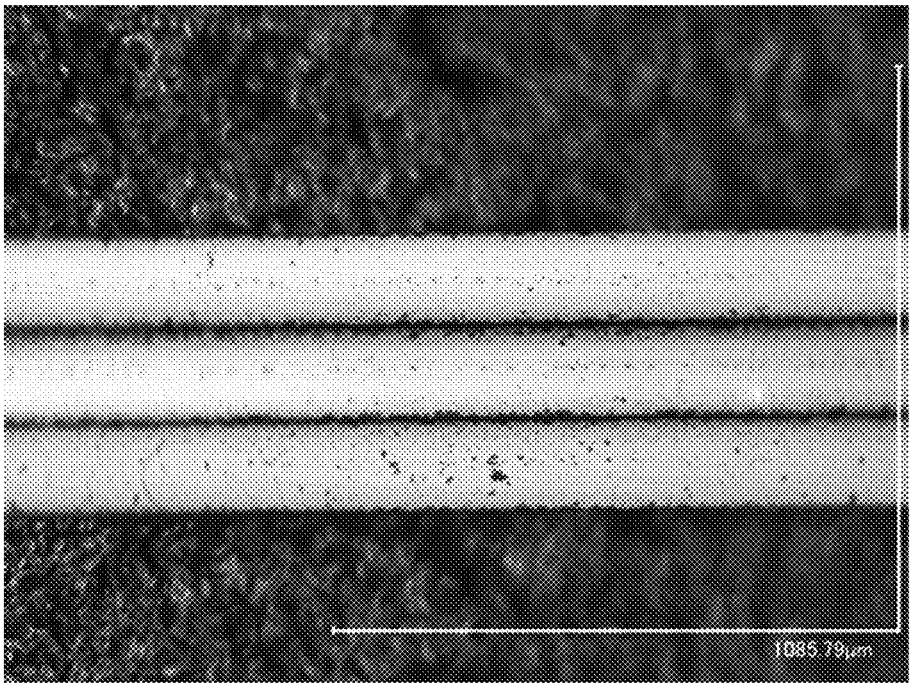
FIG. 4 is an optical microscope image showing verification results in the Examples.

The state of crack generation of the sample of the thermistor (before electrode formation) of Invention Example 1 obtained in this manner was observed with an optical microscope and an electron microscope. FIG. 4 shows an optical microscope observation image of Invention Example 1 and FIG. 5 shows an SEM observation image.

In the crack observation, the surface of the thermistor with a protective film was coated with an antistatic coating by carbon vapor deposition, observation was performed at 5 points on the surface of the $SiO_2$ protective film at the center of each region divided into 5 equal parts in the long side direction at a central part excluding 20μm from the edges of the thermistor at an acceleration voltage of 5 kV and 5000 times magnification using a field emission scanning electron microscope (SU8000: manufactured by Hitachi High-Technologies Corporation), and a case where there were 1 or fewer cracks with a crack length of 5μm or more per field was judged as being without cracks.

Figure 5:
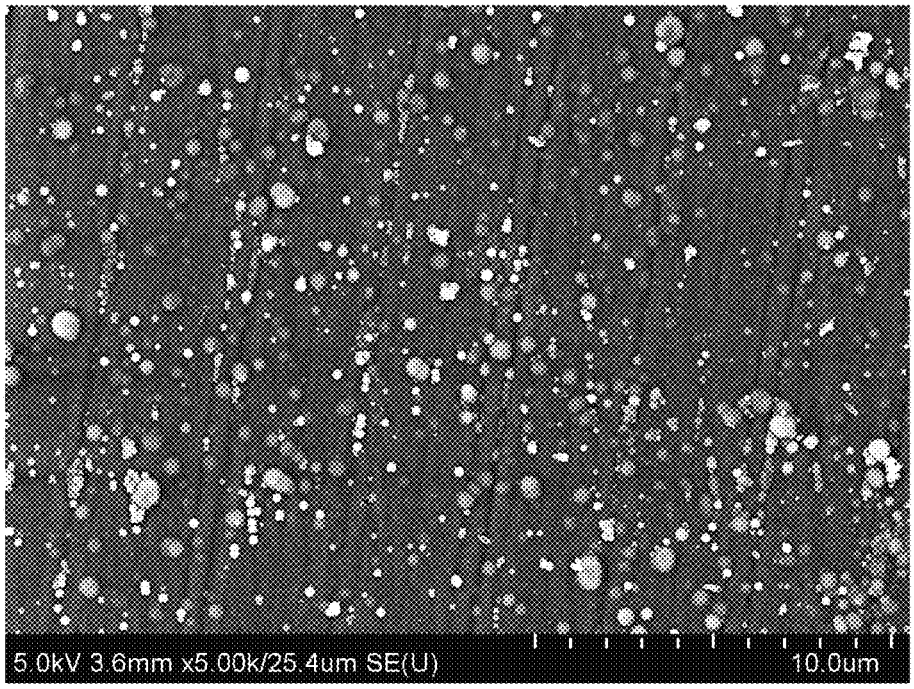
FIG. 5 is an electron microscope image showing verification results in the Examples.

In FIG. 4, the three linear portions are the $SiO_2$ protective film, while FIG. 5 is an SEM image of the portion of the $SiO_2$ protective film. The white dot shapes in FIG. 5 are contaminations ($SiO_2$ particles) and not cracks or the like. As shown in FIG. 4 and FIG. 5, it was confirmed that the protective film of the thermistor of Invention Example 1 did not show any damage such as cracks and that a smooth protective film without scratches was formed.

Figure 6:
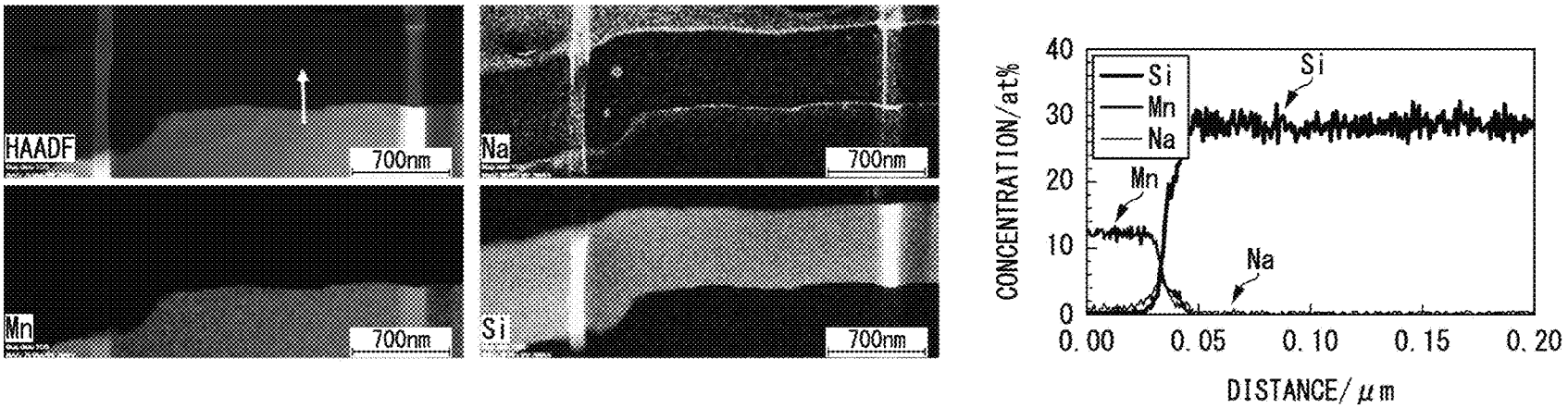
FIG. 6 is a HAADF image, an element mapping image, and a line analysis graph, which show verification results in the Examples.

Next, using a focused ion beam processing observation device (SMI3050TB: manufactured by SII Nano Technologies Co., Ltd.), a TEM observation sample sliced to a thickness of 80 to 100 nm from the surface of the thermistor of Invention Example 1 was prepared and observed with a transmission-type electron microscope (Titan G2: manufactured by FEI Co., Ltd.). The observation conditions were an accelerating voltage of 200 kV and a probe diameter of 0.1 nm, and a HAADF image observed at 160,000 times magnification, element mapping results, and line analysis results are shown in FIG. 6 before heat treatment and in FIG. 7 after heat treatment. The arrows in the HAADF images of FIG. 6 and FIG. 7 are the locations where the line analysis was performed.

Figure 7:
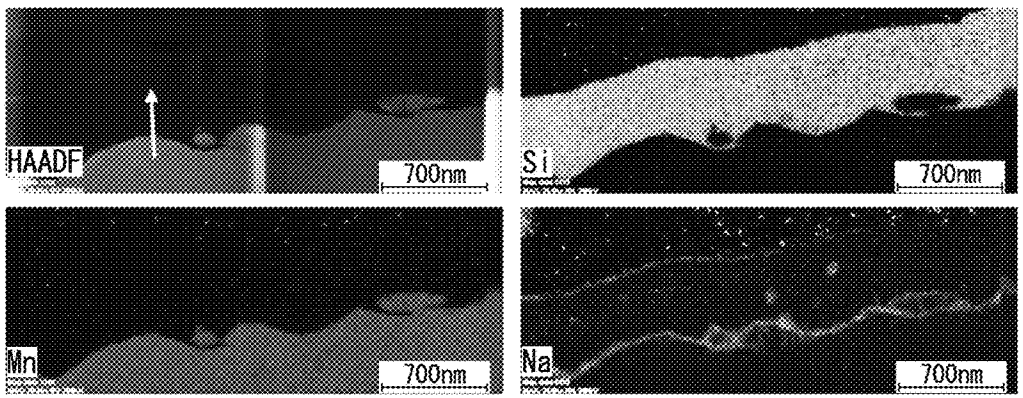
FIG. 7 is a HAADF image, an element mapping image, and a line analysis graph, which show verification results in the Examples.
Figure 7:
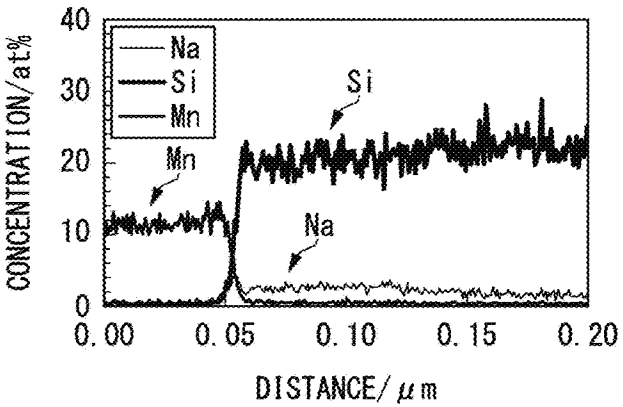

According to the results shown in FIG. 6 and FIG. 7, it was confirmed that the alkali metal Na used as a catalyst was unevenly distributed in the region including the interface between the thermistor element and the $SiO_2$ protective film, for example, on the protective film side in the vicinity of the interface. In the line analysis, from the result of composition mapping obtained by integrating 985 times in 1.7 s per frame at a resolution of 512×512 pixels at a magnification of 160,000 times magnification, a spectrum was extracted in a line shape for each pixel.

Next, the thermistor after the heat treatment of Invention Example 1 was attached to a dicing sheet, cut to 0.365 nun, and Ag paste (Himec DP4000 series: manufactured by Namics Corporation) was coated on both cut end surfaces and fired at 750° C. to form a base electrode. Subsequently, when a Ni plating film was formed by barrel plating using a sulfamic acid-based acidic plating solution and then a Sn plating film was further formed thereon, there was no peeling or cracking of the protective film as shown in FIGS. 4 and 5, thus, it was possible to manufacture a chip thermistor without erosion of the thermistor element due to the plating.

Invention Example 2

The conditions were the same as in Invention Example 1, except that KOH was used as the alkali and alkali metal source as the catalyst. As a result, in the same manner as in Invention Example 1, the alkali metal K used as a catalyst was unevenly distributed at the interface between the thermistor element and the $SiO_2$ protective film, peeling or cracking of the protective film was not observed and it was possible to manufacture a chip thermistor without erosion of the thermistor element due to the plating.

Invention Example 3

As the thermistor base, a thermistor element having a prismatic shape of 0.18 mm×0.18 mm×38 mm was prepared. Then, 5.6 g of 2-propanol (manufactured by Tokyo Chemical Industry Co., Ltd.), 0.30 g of silicon alkoxide (silicate 40: manufactured by Tama Chemicals Co., Ltd.), and a solution obtained by dissolving 2.5 mg of KCl as an alkali metal source in 3.2 g of 25 wt % concentration ammonia water as a catalyst alkali were added to a Laboran screw tube bottle No. 5 (volume 20 mL) to prepare a reaction solution.

Then, the thermistor element having the shape described above was added to the reaction solution, stirred and mixed. Then, the mixture was heated in a water bath at 40° C. for 30 minutes to cause a reaction. After the reaction finished, the thermistor element was taken out, washed with ion-exchanged water, and dried. This operation was repeated until the film thickness grew to 200 nm and then a heat treatment was performed at 700° C. for 10 minutes in the air.

The state of crack generation of the sample of the thermistor (before electrode formation) of Invention Example 3 obtained in this manner was observed with an optical microscope and an electron microscope in the same manner as in Invention Example 1. As a result, cracking or peeling was not observed in the $SiO_2$ protective film.

Figure 8:
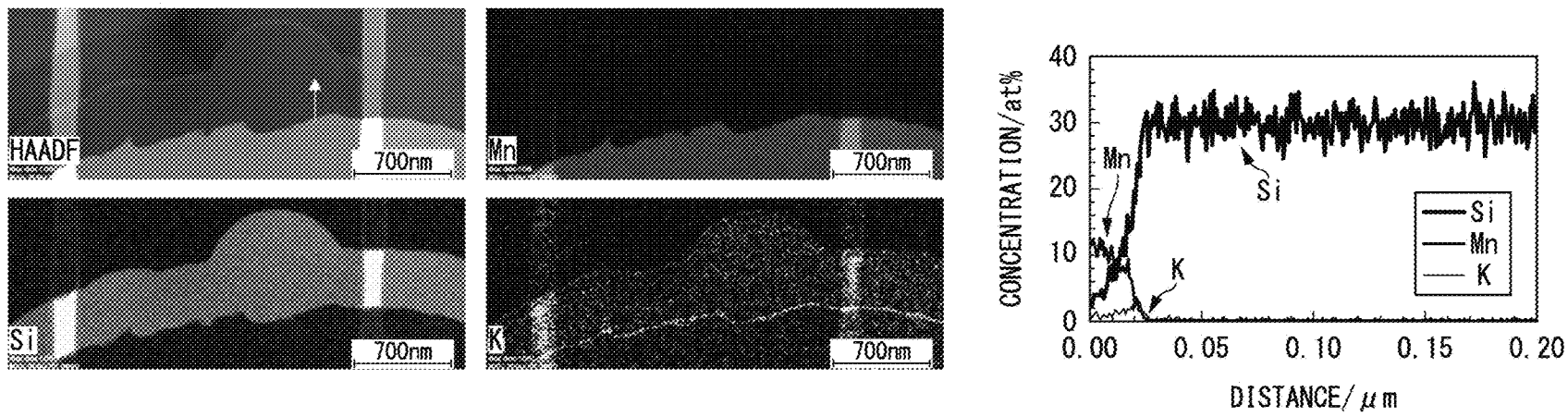
FIG. 8 is a HAADF image, an element mapping image, and a line analysis graph, which show verification results in the Examples.

Next, in the same manner as Invention Example 1, a sample for TEM observation was prepared using a focused ion beam processing observation device and observation was performed with a transmission-type electron microscope. The observation conditions were an accelerating voltage of 200 kV and a probe diameter of 0.1 nm, and a HAADF image observed at 160,000 times magnification, element mapping results, and line analysis results are shown in FIG. 8 before heat treatment and in FIG. 9 after heat treatment. The arrows in the HAADF images of FIG. 8 and FIG. 9 are the locations where the line analysis was performed.

Next, the thermistor after the heat treatment of Invention Example 3 was attached to a dicing sheet, cut to 0.365 mm, and Ag paste (ANP-1: manufactured by Nihon Superior Co., Ltd.) was coated on both cut end surfaces, dried, and then fired at 300° C. for 60 minutes in the air to form a base electrode.

Figure 9:
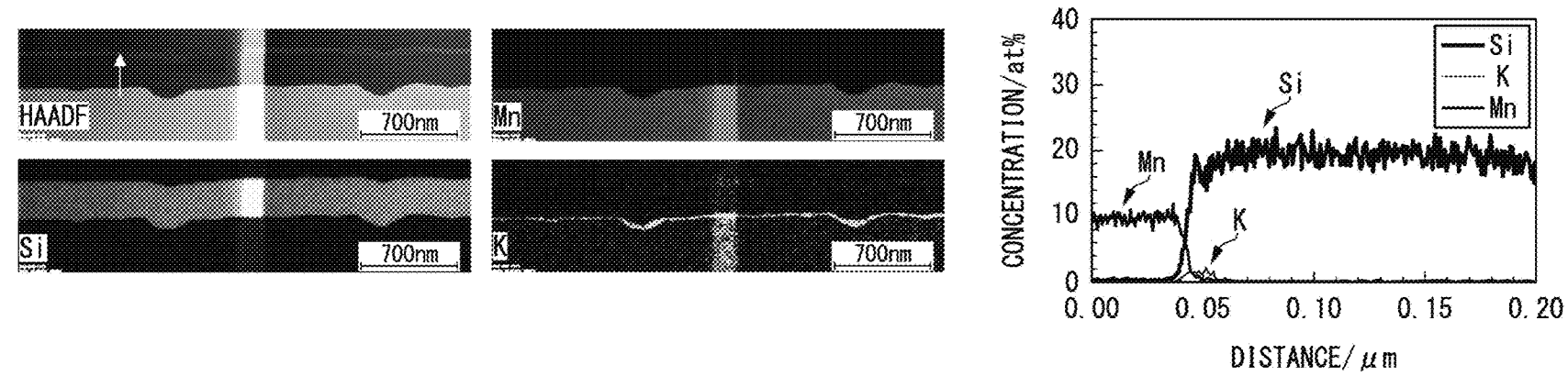
FIG. 9 is a HAADF image, an element mapping image, and a line analysis graph, which show verification results in the Examples.

According to the results shown in FIG. 8 and FIG. 9, it was confirmed that, even in a case of changing to a solution in which KCl was dissolved in ammonia water as the catalyst alkali and alkali metal source, the alkali metal K used as a catalyst was unevenly distributed in the region including the interface between the thermistor element and the $SiO_2$ protective film. Also in Invention Example 3, peeling or cracking of the protective film was not observed and it was possible to manufacture a chip thermistor without erosion of the thermistor element due to the plating.

Invention Example 4

As a base on which the protective film was formed, a thermistor element having a prismatic shape of 0.18 mm×0.18 mm×38 mm was prepared. Then, in a Laboran screw tube bottle No. 5 (volume 20 mL), 2.5 mg of NaCl as an alkali metal source was dissolved in 2.9 g of ion-exchanged water and 5.6 g of a 99% methanol-modified alcohol (ethanol 89.84%, methanol 10.16%, Vitrex 10 ppm: manufactured by Imazu Chemical Co., Ltd.), and 0.30 g of tetraethoxysilane (manufactured by Tama Chemicals Co., Ltd.) as a silicon alkoxide and 0.3 g of anhydrous ethylenediamine as an alkali catalyst were further added thereto to obtain a reaction solution.

Then, the thermistor element having the shape described above was added to the reaction solution, stirred and mixed. Then, the mixture was heated in a water bath at 40° C. for 30 minutes to promote a hydrolysis reaction and a polycondensation reaction. After the reaction finished, the thermistor element was taken out, washed with ion-exchanged water, and dried. This operation was repeated until the film thickness of the protective film grew to 200 nm and then a heat treatment was performed at 700° C. for 10 minutes in the air.

As a result, it was confirmed that the alkali metal Na was unevenly distributed at the interface between the thermistor element and the $SiO_2$ protective film. Also in Invention Example 4, peeling or cracking of the protective film was not observed and it was possible to manufacture a chip thermistor without erosion of the thermistor element due to the plating.

Invention Example 5

This Example was carried out under the same conditions as in Invention Example 1, except that the film thickness of the $SiO_2$ protective film formed on the thermistor element was 50 nm. As a result, in the same manner as in Invention Example 1, it was confirmed that the alkali metal Na was unevenly distributed at the interface between the thermistor element and the $SiO_2$ protective film. Also in Invention Example 5, peeling or cracking of the protective film was not observed and it was possible to manufacture a chip thermistor without erosion of the thermistor element due to the plating.

Invention Example 6

This Example was carried out under the same conditions as in Invention Example 1, except that the film thickness of the $SiO_2$ protective film formed on the thermistor element was 580 nut As a result, in the same manner as in Invention Example 1, it was confirmed that the alkali metal Na was unevenly distributed at the interface between the thermistor element and the $SiO_2$ protective film. Also in Invention Example 6, peeling or cracking of the protective film was not observed and it was possible to manufacture a chip thermistor without erosion of the thermistor element due to the plating.

Invention Example 7

This Example was carried out under the same conditions as in Invention Example 1, except that the film thickness of the $SiO_2$ protective film formed on the thermistor element was 960 nm. As a result, in the same manner as in Invention Example 1, it was confirmed that the alkali metal Na was unevenly distributed at the interface between the thermistor element and the $SiO_2$ protective film. Also in Invention Example 7, peeling or cracking of the protective film was not observed and it was possible to manufacture a chip thermistor without erosion of the thermistor element due to the plating.

Comparative Example 1

As a base on which the protective film was formed, a thermistor element having a prismatic shape of 0.18 mm×0.18 mm×38 mm was prepared. Then, 5.6 g of a 99% methanol-modified alcohol (ethanol 89.84%, methanol 10.16%, Vitrex 10 ppm: manufactured by Imazu Chemical Co., Ltd.), 0.30 g of tetraethoxysilane (manufactured by Tama Chemicals Co., Ltd.) as a silicon alkoxide, and 3.2 g of 25 wt % concentration ammonia water as a catalyst were added to a Laboran screw tube bottle No. 5 (volume 20 mL) to obtain a reaction solution.

Then, the thermistor element having the shape described above was added to the reaction solution, stirred and mixed. Then, the mixture was heated in a water bath at 40° C. for 30 minutes to promote a hydrolysis reaction and a polycondensation reaction. After the reaction finished, the thermistor element was taken out, washed with ion-exchanged water, and dried. This operation was repeated until the film thickness of the protective film grew to 200 nm and then a heat treatment was performed at 700° C. for 10 minutes in the air.

Figure 10:
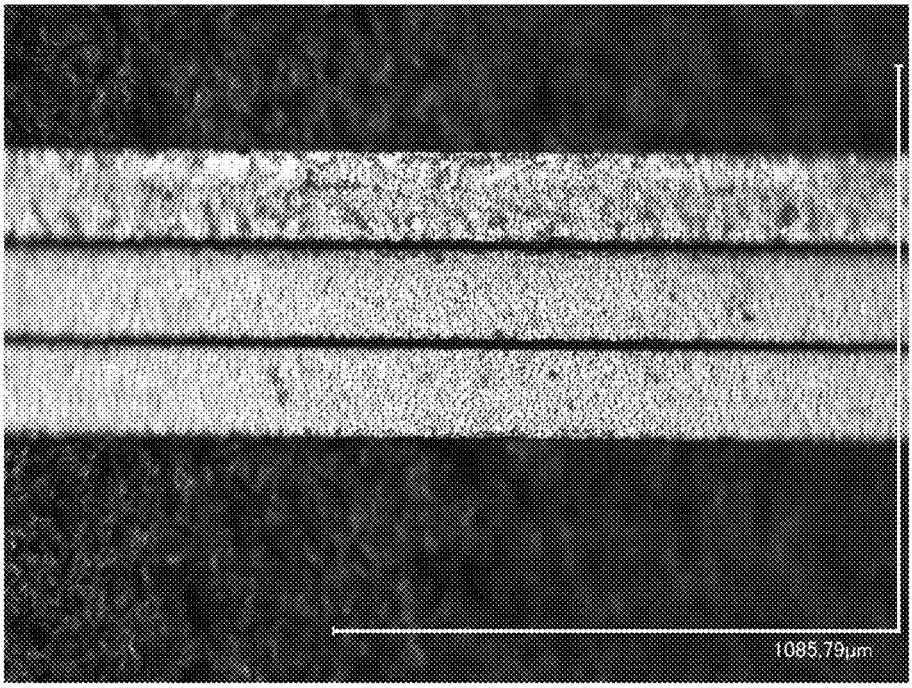
FIG. 10 is an optical microscope image showing verification results in the Examples.

The state of crack generation of the sample of the thermistor (before electrode formation) of Comparative Example 1 obtained in this manner was observed with an optical microscope and an electron microscope. FIG. 10 shows an optical microscope observation image of Comparative Example 1.

According to FIG. 10, cracks were generated on the entire surface of the $SiO_2$ protective film of Comparative Example 1, the thermistor element was eroded due to the plating and it was not possible to manufacture a chip thermistor. In addition, since an alkali metal source was not included in the reaction solution, uneven distribution of the alkali metal was not observed at the interface between the thermistor element and the protective film from the TEM-EDS line analysis.

Comparative Example 2

As a base on which the protective film was formed, a thermistor element having a prismatic shape of 0.18 mm×0.18 mm×38 mm was prepared. Then, 2.4 g of ion-exchanged water, 5.6 g of 99% methanol-modified alcohol (ethanol 89.84%, methanol 10.16%, Vitrex 10 ppm: manufactured by Imazu Chemical Co., Ltd.), 0.30 g of tetraethoxysilane (manufactured by Tama Chemicals Co., Ltd.) as silicon alkoxide, and 0.3 g of ethylenediamine as a catalyst were added to a Laboran screw tube bottle No. 5 (volume 20 mL) to obtain a reaction solution.

Then, the thermistor element having the shape described above was added to the reaction solution, stirred and mixed. Then, the mixture was heated in a water bath at 40° C. for 30 minutes to promote a hydrolysis reaction and a polycondensation reaction. After the reaction finished, the thermistor element was taken out, washed with ion-exchanged water, and dried. This operation was repeated until the film thickness of the protective film grew to 200 nm and then a heat treatment was performed at 700° C. for 10 minutes in the air.

Figure 11:
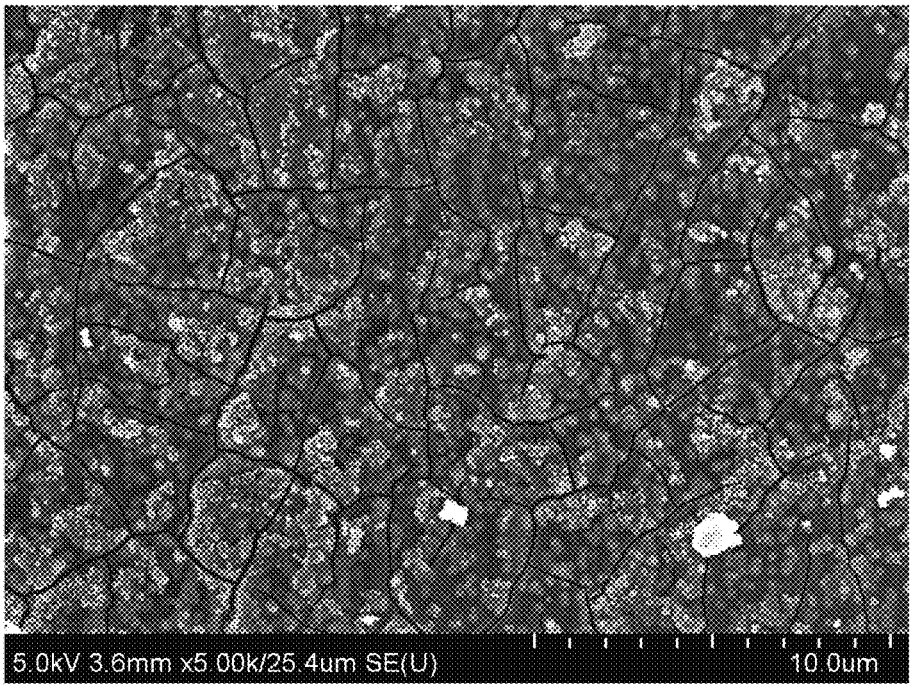
FIG. 11 is an electron microscope image showing verification results in the Examples.

The state of crack generation of the sample of the thermistor (before electrode formation) of Comparative Example 2 obtained in this manner was observed with an optical microscope and an electron microscope. FIG. 11 shows an SEM observation image of Comparative Example 2.

In the crack observation, the surface of the thermistor was coated with an antistatic coating by carbon vapor deposition, observation was performed at 5 points on the surface of the $SiO_2$ protective film at the center of each region divided into 5 equal parts in the long side direction at a central part excluding 20μm from the edges of the thermistor at an acceleration voltage of 5 kV and 5000 times magnification, a field emission scanning electron microscope (SU8000: manufactured by Hitachi High-Technologies Corporation), and a case where there were 1 or fewer cracks with a crack length of 5μm or more per field was judged as being without cracks.

As a result, cracks were not confirmed from the optical microscope image; however, as shown in FIG. 11, cracks occurred over the entire surface of the $SiO_2$ protective film in the SEM observation image, the thermistor element was eroded due to the plating, and it was not possible to manufacture a chip thermistor. In addition, from the TEM-EDS line analysis, a small amount of Na, which is considered to be derived from the cutting water during the cutting process of the thermistor element, was detected at the interface between the thermistor element and the $SiO_2$ protective film; however, an alkali metal source was not included in the reaction solution, thus, almost no uneven distribution of alkali metals was observed at the interface.

Comparative Example 3

The conditions were the same as in Invention Example 1 except that the film thickness of the protective film was 30 nm. As a result, in the same manner as in Invention Example 1, the alkali metal Na used as a catalyst was unevenly distributed at the interface between the thermistor element and the $SiO_2$ protective film and peeling or cracking of the protective film was not observed; however, since the film thickness of the protective film was as thin as 30 nm, pinholes were scattered in the protective film, the thermistor element was eroded due to the plating, and it was not possible to manufacture a chip thermistor.

Comparative Example 4

The conditions were the same as in Invention Example 1, except that the film thickness of the protective film was 1150 nm. As a result, in the same manner as in Invention Example 1, the alkali metal Na used as a catalyst was unevenly distributed at the interface between the thermistor element and the $SiO_2$ protective film; however, due to the film thickness of the protective film being as thick as 1150 nm, the difference in the coefficient of thermal expansion between the thermistor element and the protective film became large, cracks were generated due to the difference in the coefficient of thermal expansion, the thermistor element was eroded by plating, and it was not possible to manufacture a chip thermistor.

Table 1 shows a summary of the conditions of the reaction solutions, the crack determination results, and the uneven distribution of alkali metals, in Invention Examples 1 to 7 and Comparative Examples 1 to 4 as described above. For the atomic ratio of the alkali metal in Table 1, a 5-point moving average was used based on the result of line analysis. In addition, the determination result of the protective film was "acceptable" for films without cracks and "unacceptable" for films with cracks and pinholes.

TABLE 1

| | Catalyst | Alkali metal source | Film thickness (nm) | Cracks present or absent | Judgement | Moving average of 5 points of values obtained by dividing detection amount in atom % of alkali metal by detection amount in atom % of all metals | | |
|---|---|---|---|---|---|---|---|---|
| | | | | | | Maximum value in vicinity of interface | Average value in protective film | Maximum value/average value |
| Invention Example 1 | NaOH | NaOH | 200 | Absent | Acceptable | 0.13 | 0.079 | 1.6 |
| Invention Example 2 | KOH | KOH | 190 | Absent | Acceptable | 0.20 | 0.09 | 2.2 |
| Invention Example 3 | Ammonia water | KCl | 210 | Absent | Acceptable | 0.10 | 0.011 | 9.6 |
| Invention Example 4 | Ethylene diamine | NaCl | 200 | Absent | Acceptable | 0.08 | 0.012 | 6.8 |
| Invention Example 5 | NaOH | NaOH | 50 | Absent | Acceptable | 0.22 | 0.14 | 1.6 |
| Invention Example 6 | NaOH | NaOH | 580 | Absent | Acceptable | 0.22 | 0.12 | 1.8 |
| Invention Example 7 | NaOH | NaOH | 960 | Absent | Acceptable | 0.24 | 0.09 | 2.7 |
| Comparative Example 1 | Ammonia water | None | 210 | Present | Unacceptable | 0.020 | 0.00077 | 26.0 |
| Comparative Example 2 | Ethylene diamine | None | 200 | Present | Unacceptable | 0.025 | 0.0010 | 25.0 |
| Comparative Example 3 | NaOH | NaOH | 30 | None (pinholes present) | Unacceptable | 0.21 | 0.12 | 1.8 |
| Comparative Example 4 | NaOH | NaOH | 1150 | Present | Unacceptable | 0.25 | 0.089 | 2.8 |

According to the results of the confirmation experiments shown in Table 1, in Invention Examples 1 to 7, the maximum value of the ratio of the alkali metal, which was obtained by dividing the detected amount (atom %) of alkali metal by the detected amount (atom %) of all the metals and which shows the uneven distribution of the alkali metal in the region including the interface between the thermistor element and the $SiO_2$ protective film, was 0.08 at the lowest (Invention Example 4), while a value obtained by dividing this maximum value by the average value of the ratio of the alkali metal of the protective film was 1.6 at the lowest (Invention Example 1 and Invention Example 5). Due to this, it was confirmed that in Invention Examples 1 to 7, alkali metals (Na, K) were unevenly distributed in the region including the interface between the thermistor element and the $SiO_2$ protective film. In Invention Examples 1 to 7, due to the uneven distribution of the alkali metal in the region including the interface, cracks causing peeling of the protective film were not observed and high adhesion of the protective film to the thermistor element was confirmed.

On the other hand, in Comparative Example 1 and Comparative Example 2, since the alkali metal compound was not included in the reaction solution at the time of forming the protective film, the maximum value of the alkali metal presence ratio in the region including the interface was as low as 0.020 in Comparative Example 1 and 0.025 in Comparative Example 2 (this is considered to be derived from the cutting water during the process of cutting the thermistor element), and cracks occurred in the protective film. It is considered that this is because the concentration of alkali metal at the interface between the thermistor element and the $SiO_2$ protective film was low, thus, the growth of particles in the protective film was not promoted and cracks occurred as a result. Therefore, in Comparative Example 1 and Comparative Example 2, it was understood that peeling of the protective film due to cracks easily occurs.

In addition, in Comparative Example 3, since the film thickness of the protective film was as thin as 30 nm, the thermistor element was not completely covered with the $SiO_2$ protective film and a plurality of pinholes were generated. It was found that, due to the pinholes, the plating solution penetrated into the thermistor element when an electric portion was formed and the thermistor element was eroded, thus, it was not possible to manufacture the thermistor with a protective film in Comparative Example 3. Furthermore, in Comparative Example 4, it was found that since the film thickness of the protective film was excessively thick at 1150 nm, cracks were generated due to the difference in the coefficient of thermal expansion between the thermistor element and the protective film and these cracks caused the plating solution to penetrate into the thermistor element when the electric portion was formed such that the thermistor element was eroded, thus, it was not possible to manufacture a thermistor with a protective film in Comparative Example 4.

From the above results, it was confirmed that setting the film thickness of a protective film formed of a $SiO_2$ film to a range of 50 nm or more and 1000 nm or less and unevenly distributing the alkali metal at the interface between the thermistor element and the protective film makes it possible to obtain a thermistor provided with a protective film that has no cracks and little peeling.

REFERENCE SIGNS LIST

10 Thermistor

11 Thermistor element

13 Electrode portion

20 Protective film

What is claimed is:

1. A thermistor with a protective film, comprising:

a thermistor element;

a protective film formed of a $SiO_2$ film having a film thickness in a range of 50 nm or more and 1000 nm or less and formed in contact with the thermistor element; and an electrode portion, wherein an alkali metal is unevenly distributed in a region including an interface between the thermistor element and the protective film, and as obtained by line analysis in a direction perpendicular to the interface using an energy dispersion type X-ray spectroscopic analyzer, a maximum value of an alkali metal presence ratio, in which a detection amount (atom %) of the alkali metal is divided by a detection amount (atom %) of all metals in a region including the interface, is 0.03 or more, and a value obtained by dividing the maximum value by an average value of the alkali metal presence ratio in the protective film is 1.5 or more.

2. A method for manufacturing a thermistor with a protective film which is a method for manufacturing the thermistor with a protective film including a thermistor element, a protective film formed of a $SiO_2$ film having a film thickness in a range of 50 nm or more and 1000 nm or less and formed in contact with the thermistor element, and an electrode portion, the method comprising:

a protective film-forming step of forming the protective film by immersing the thermistor element in a reaction solution including silicon alkoxide, an alkali metal, water, an organic solvent, and an alkali, and causing $SiO_2$ to precipitate on a surface of the thermistor element by a hydrolysis reaction and a polycondensation reaction of the silicon alkoxide, wherein in the protective film, the alkali metal is unevenly distributed in a region including an interface between the thermistor element and the protective film.

3. The method for manufacturing a thermistor with a protective film according to claim 2, the method further comprising:

an electrode portion-forming step of forming the electrode portion by coating a metal paste on both end surfaces of the thermistor element and firing the metal paste, which is a subsequent step to the protective film-forming step.

* * * * *